US005156451A

United States Patent [19]

Pollock

[11] Patent Number: 5,156,451

[45] Date of Patent: Oct. 20, 1992

[54] APPARATUS HAVING A HIGH CENTER OF GRAVITY WITH ENERGY ABSORBING DEVICE

[75] Inventor: Richard A. Pollock, Fresno, Calif.

[73] Assignee: The Vendo Company, Fresno, Calif.

[21] Appl. No.: 803,789

[22] Filed: Dec. 6, 1991

Related U.S. Application Data

[63] Continuation of Ser. No. 543,258, Jun. 25, 1990, abandoned.

[51] Int. Cl.[5] ..... A47B 91/00

[52] U.S. Cl. ..... 312/351.3; 267/178; 267/289; 248/616; 248/636

[58] Field of Search ..... 248/638, 636, 602, 618, 248/615, 616, 677; 267/169, 174, 178, 289; 221/15, 13; 312/254, 255, 276

[56] References Cited

U.S. PATENT DOCUMENTS

| | | | |
|---|---|---|---|
| 1,390,326 | 9/1921 | Barry | 267/289 |
| 1,460,771 | 7/1923 | Stoner | 267/289 |
| 1,912,451 | 6/1933 | Hibbard | 248/638 X |
| 2,145,037 | 1/1939 | Bennett | 248/616 X |
| 2,279,093 | 4/1942 | Peters | 221/15 |
| 2,390,277 | 12/1945 | Simpkins | 221/15 X |
| 2,664,941 | 1/1954 | Gillespie | 248/602 X |
| 2,683,576 | 7/1954 | Miller | 248/677 X |
| 2,852,883 | 9/1958 | Walsh | 248/616 X |
| 4,623,132 | 11/1986 | Smith | 267/121 X |

*Primary Examiner*—Karen J. Chotkowski

*Attorney, Agent, or Firm*—Robbins, Dalgarn, Berliner & Carson

[57] ABSTRACT

An apparatus having a high center of gravity incorporating an energy absorbing device is disclosed. The energy absorbing device includes a rapidly extending shock absorbing device to absorb and thereby dampen the forward motion of an apparatus having a high center of gravity such as a vending machine subjected to a tipping force in the lateral direction. A method of fabrication for example a vending machine having an energy absorbing device is also described. In the vending machine example, the energy absorbing device prevents an individual from using a rocking motion to develop sufficient angular momentum enabling the individual to tip the vending machine into a forward position.

3 Claims, 2 Drawing Sheets

APPARATUS HAVING A HIGH CENTER OF GRAVITY WITH ENERGY ABSORBING DEVICE

This application is a continuation of application Ser. No. 07/543,258, filed Jun. 25, 1990 which is now abandoned.

BACKGROUND OF THE INVENTION

The present invention relates to a high center of gravity apparatus such as a vending machine having an energy absorbing device; and more particularly to an energy absorbing device operable to provide a dampened forward motion preventing the forward tipping of the vending machine when subjected to lateral forces.

Momentum absorbing devices have been fabricated.

U.S. Pat. No. 4,623,132 to L. O. Smith issued Nov. 18, 1986 entitled "Gas Spring Counterbalance System", discloses a gas spring assisted counterbalance system for a closure member. Specific application of such a closure member would be for a rear door of a hatchback automobile or any other mechanical spring connected in series with a gas spring. The Smith system is arranged so that a gas spring reaches a fully retracted position before the door or member that is supported is fully closed. After the door is closed against the force of the mechanical spring, the longitudinal vibrations or short movements of the system which otherwise would impart undesired short stroke cycles to the gas spring are absorbed by the mechanical spring. The absorption of the energy by the mechanical spring increases the operating lifetime of the gas spring. A specific feature of the Smith invention is a provision made on the gas spring for a stop member carried by a piston rod which abuts against the end of the cylinder to define the fully retracted position of the gas spring and to transmit loads directly through the mechanical components of the gas spring independent of the pneumatic fluid.

The D. A. Thomas U.S. Pat. No. 4,506,748 issued Mar. 26, 1985 entitled "Battery Shock Eliminator", discloses an assembly mounted cell battery on a vehicle frame subjected to a significant amount of jarring. A component of the Thomas invention is an assembly secured to the vehicle frame that is also movably mounted to the battery. The supported battery is interconnected by a shock attenuating means such that the force which is subjected to the jarring vehicle frame is transmitted in attenuated amounts to the battery that is supported by the battery shock eliminator. The shock absorbing means interconnects the housing which supports the battery and a base member which also supports the battery such that when the vehicle and the base member which the battery is fixably secured to are subjected to forces, the full force of this jarring will not be transmitted to the battery containing housing due to the shock absorbing means that interconnects the base member to the housing. The patented Thomas device is pertinent in that the damping mechanism or shock absorber is attached to a specific load to attenuate the shock which is applied to the load and to protect the specific load from damage due to this jarring.

In the effort to cause a vending machine to discharge a vended item without the deposit of money to pay for the item, it is possible to shake, rock or topple the machine by applying lateral forces to the top of the machine. Rocking the machine back and forth allows the angular momentum to build up to a point where it can be pulled forward beyond its neutral stability point resulting in the discharge of one of its vended items without a coin deposit.

The force required to tip a fully loaded vending machine forward is in the range of 100+ pounds of force when applied, horizontal at the top of the machine. Given the angles and frictional force between a human being's hands and the machine surface, the individual and the floor, this force is very difficult to achieve by just one pull. Thus, a human being must push backward at some angle and let the machine rapidly rock forward. Through the rocking of the machine fore and aft, it is possible to develop sufficient energy to allow the machine to be pulled forward. If only one individual is involved, it would be necessary for him to move the machine one or two feet from a wall because he would be incapable of rocking or pulling the machine from the front to tip it over. For example, if an individual pulls the machine toward themselves in order to cause the machine to free vend a vending item, there is a possibility the machine will fall and be damaged, or cause human injury.

It is therefore advantageous to solve the problem of the manipulation of a vending machine by initiating a method to control the forward and backward energy of the machine if the machine is subjected to high lateral forces at its surface.

SUMMARY OF THE INVENTION

The present invention, an energy absorbing device suitable for use on an apparatus having a high center of gravity such as a vending machine, solves the problem of being able to manipulate the machine in a rocking manner resulting in a free vending of the vended articles.

It is an objective of this device, through the incorporation of a rapidly extending energy absorbing device, to absorb and dampen the forward motion of a vending machine. This absorption of the forward motion prevents this energy from being built up in the machine such that the machine will rock past its point of neutral stability, in the forward direction.

The invention provides a force absorbing means having a spring or hydraulic actuated system with an extending leg operable to take the vertical load and respond to that vertical load thereby storing the energy of the lateral forces subjected to the vending machine.

This energy absorbing device operable for use with a vending machine would include a cylinder containing a first spring which is mounted upon a piston and is cooperatively associated with the piston. In an alternative embodiment, a second spring which surrounds the piston shaft, and is on the exterior of the cylinder further serves as an energy storage means. The extension of the piston causes the energy to be absorbed on the return stroke.

A method of fabrication for an energy absorbing device mountable on a vending machine is also disclosed.

BRIEF DESCRIPTION OF THE DRAWINGS

A complete understanding of the present invention and of the above advantages may be gained from a consideration of the following description of the preferred embodiments taken in conjunction with the accompanying drawings in which.

DETAILED DESCRIPTION OF THE PREFERRED EMBODIMENT

The invention, an energy absorbing device operable for use with a vending machine contains an energy absorbing stabilizer having either a spring, air or hydraulic actuated cylinder containing, in one embodiment an internal first spring, cooperatively associated with a piston which extends outside of a frame supporting the vending machine. This energy absorbing device is mounted at floor level on one side of the vending machine. The piston responsively reciprocates within the cylinder and the shaft of the cylinder extends outside of the cylinder where in an alternative embodiment, a second spring surrounds the shaft. The shaft terminates in a foot-like member which contacts the floor.

When an individual attempts to shake or tilt the vending machine or develop a free-swinging energy of the machine in order to get a free vend of a product from the machine, the energy absorbing stabilizer absorbs the energy. Every time the force is applied to the top of the vending machine shoving it backwards the weight of the vending machine shifts and the spring actuated absorbing stabilizer extends its piston shaft foot as the piston reciprocates within the cylinder in response to the expanding spring or hydraulic means. This extension occurs due to the extension of the spring within and in the alternative embodiment, without the cylinder. When the vending machine rotates back towards its upright position the foot contacts the floor and the springs on air or hydraulic fluid function to absorb the energy generated by the moving vending machine. The momentum that is developed in the vending machine from the rearward lateral forces is thereby absorbed and the momentum buildup by rocking is prevented.

Figure 1:
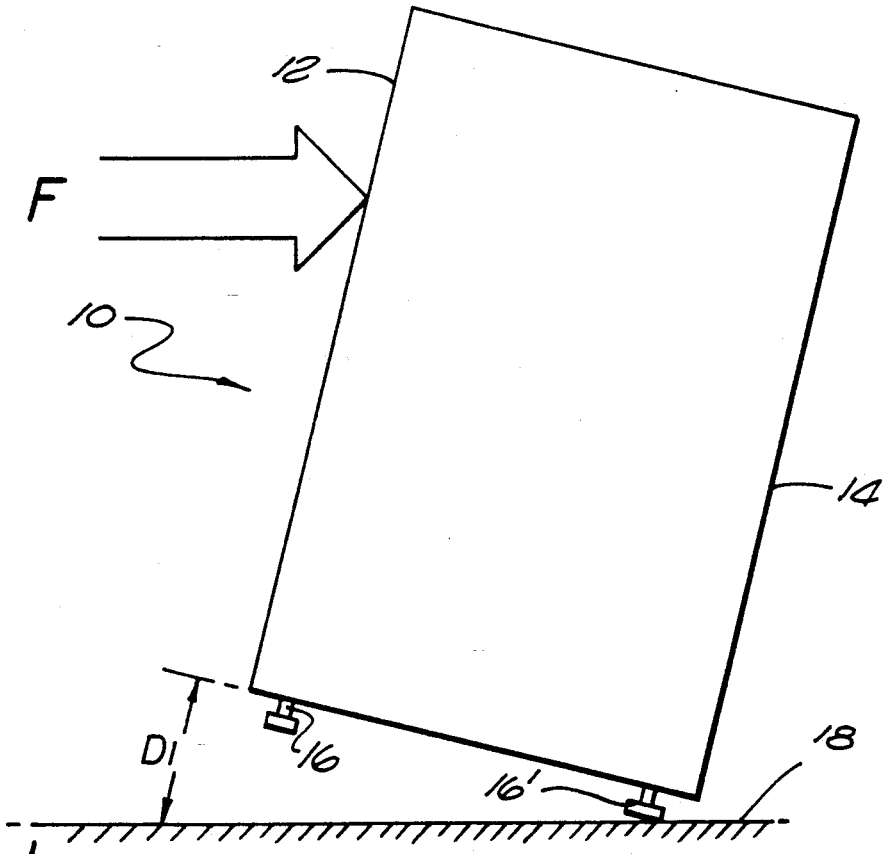
FIG. 1 is a schematic representation side view of a vending machine.

In FIG. 1, there is shown a schematic representation of a vending machine in side view, the vending machine 10 having a front 12 and a rear 14, is shown subjected to a lateral force F at the top of the machine. Two feet 16 and 16' of the machine 10 which can be seen in the side view, represent the front foot and the rear foot, respectively of the machine.

In FIG. 1, the vending machine 10 is shown tipped backward with the front foot lifted off the floor 18 and the base of the machine is a distance D1 from the floor 18. If an individual applies continued force F to the front of the machine, and then allows the machine to fall forward to its upright position, a rocking motion or energy will be imparted to the machine 10 such that the machine can conceivably fall forward or be pulled forward upon the individual, hurting them and damaging the machine.

Figure 2:
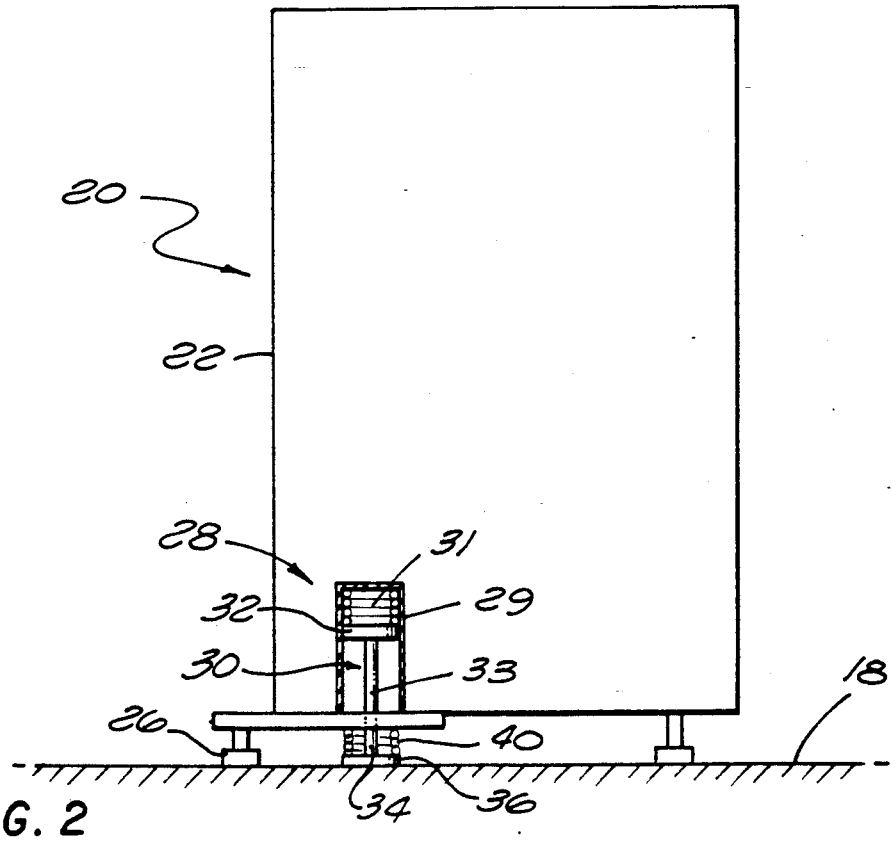
FIG. 2 is a schematic representation of one example of the preferred embodiment, an energy absorbing device mounted to a vending machine.

FIG. 2 is a schematic representation side view of one example of the preferred embodiment of an energy absorbing device or self-stabilizer mounted to the bottom surface of a conventional vending machine.

As can be seen in FIG. 2, the vending machine 20 is at rest on the floor 18. In this position all four feet of the vending machine 20 are in contact with the floor. The vending machine 20 has an energy absorbing device 28, which comprises an extended foot 26 which has been mounted to the base of the vending machine 20. This energy absorbing device contains a cylinder 29. Within the cylinder 29 is a first spring 31 and piston 30. The piston 30 has the piston head 32, a piston shaft 33 and the base of the piston shaft 34 which ends in a rubber foot 36. The rubber foot 36 is opposite the piston head 32 on the piston shaft 33. This piston 30 is reciprocally mounted within the cylinder 29 and reciprocates in response to the addition and removal of weight upon the base of the piston shaft 34.

Figure 3:
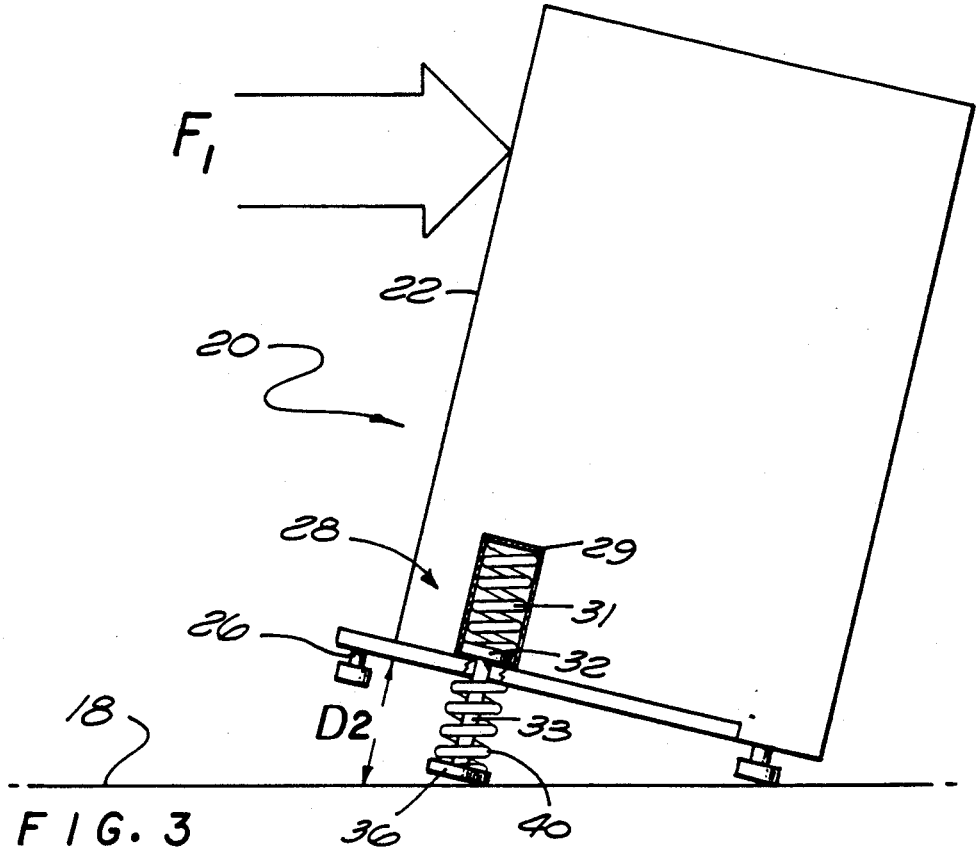
FIG. 3 is a schematic representation side view of one example of the preferred embodiment, an energy absorbing device mounted to a vending machine with the springs extended.

In FIG. 3 a second spring 40 is shown encircling the shaft 33 of the piston 30 which extends outside of the cylinder 29. Second spring 40 is further operable to dampen the energy of the rocking vending machine 20 producing a shift in weight upon the energy absorbing device 28 when a lateral force, F is applied to front surface 22 of the machine 20 or the rear surfaces of the machine 20. The first spring 31 and the second spring 40 are compressed in this example by the full weight of the vending machine 20 resting upon the foot 36 of the piston 30.

FIG. 3 is a schematic representation side view of a vending machine 20 with energy absorbing device 28. In this example, the vending machine is subjected to a rearward lateral force F1. This lateral force, F1 is applied to the front surface 22 of the machine 20 and causes the machine 20 to rotate backwards shifting the full weight of machine 20 onto rear leg 26'. The machine 20 with the energy absorbing means 28 moves backwards, such that its rear leg 26' operates as a pivot point with the floor 18, the front leg 26 is raised above the floor at a distance D2.

The spring actuated energy absorbing device 28 extends the piston foot 36 towards the floor as the piston head 32 is subjected to the extending force of the first spring 33.

Second spring 40 extends below the piston 30 encircling the piston shaft 33 contacting floor 18 through rubber foot 36. When the lateral force F1 is released, the weight shifted vending machine 20 attempts to return to its original upright position. The energy is built up because the machine 20 rotates forward. This energy is dissipated by the weight of the machine 20 being absorbed by absorbing means 28 contacting the floor 18 and compressing the springs 31 and 40, thereby dampening the rocking of the machine 20. The force F1 required to tip a loaded vending machine forward, is in the approximate range of 100 pounds where the force, F1 is applied horizontally at the top of the machine.

The object of this device, the energy absorbing means 28, 28' incorporates a rapidly extending spring loaded or hydraulic shock absorbing means to absorb and dampen this forward motion of the vending machine and prevent its momentum from building up and tipping over. The stroke necessary for the vending means energy absorbing means to allow for a one inch piston shaft extension and 10° of forward tip of the vending machine would-incorporate one or two of such energy absorbing devices 28, 28' depending upon their mountability and the machine's construction. Forward motion can be dampened such that the free return of the machine to its upright position could take as little as 1.5 to 2 second One possible type of installation for the energy absorbing device 28 as shown in FIG. 3 and FIG. 2 would include a plate bolted to the exterior of the machine. Alternatively, the energy absorbing device could be mounted inside the vending machine directly to the base.

Figure 4:
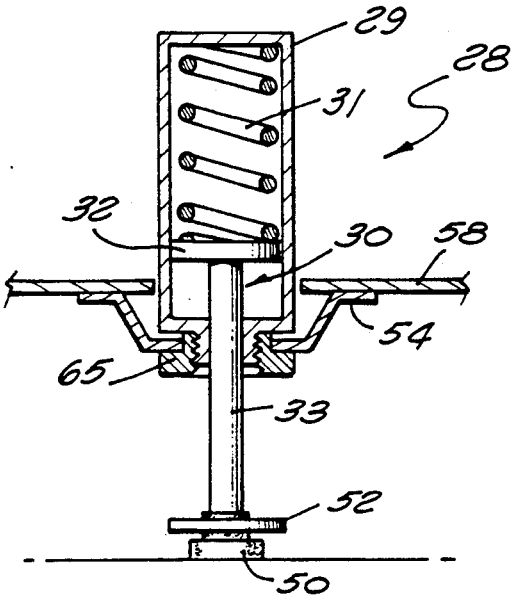
FIG. 4 is a cross sectional view of one embodiment of the energy absorbing device with the springs extended.

FIG. 4 is a schematic representation cross sectional view of an energy absorbing device 28 which has been mounted into a threaded holder welded to the base of the vending machine 20. As can be seen in the drawing, the energy absorbing device 28 comprises a cylinder 29 with at least one spring 31 engaging the top 32 of a piston 30 having a piston shaft 33. The threaded means 65 is mounted with a mounting bracket 54 and metal support plate 58 wherein it can be welded into place. This threaded retainer 65 is operable to take a vertical load. The shaft 33 of the piston 30 extends outside of the threaded device 65 and is further operable to compress a washer 52 which encircles the foot of the energy absorbing device 28, this foot 50 is at the end of the shaft 33 of the piston 30. The rubber foot 50 directly encounters the floor 18 during the forward tipping process of the vending machine and of course when the full weight of the machine is resting upon all four feet equally.

Figure 5:
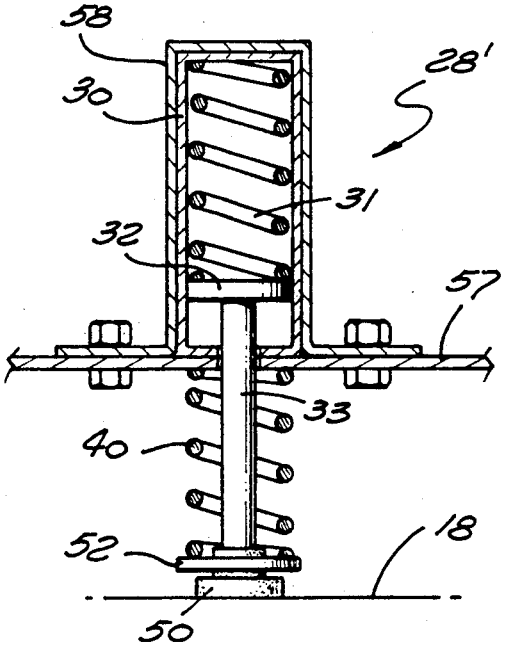
FIG. 5 is an alternative embodiment of the energy absorbing device with the springs compressed.

Finally, in FIG. 5 there is shown an alternative embodiment of the present invention which allows the bolting of the energy absorbing device 28', to the base of the machine. The cylinder 30 is received within a cover 58 which is secured by fasteners such as bolts 62 and nuts 64 to the vending machine base 57. The cylinder 30 contains a spring device 31 which rests upon the piston head 32. The piston head 32 is at the end of piston shaft 33 which is surrounded by a second spring 40. This second spring 40 extends along the piston shaft 33 between the machine base 57 and the washer 52 disposed on the shaft 33 adjacent the foot 50. As will be apparent to those skilled in the art, the embodiment of FIG. 5 permits the use of additional spring members should such be desired. When the vending machine is rocked and weight is removed from the extendable foot 50, the springs 31 and 40 extend thereby driving the foot 50 further away from the base 57 than the fixed feet 26 upon which the vending machine rests. As the vending machine returns to the vertical position, the extendable foot 50 engages the floor 18 before the fixed foot 26 causing the springs 31 and 40 to compress thereby absorbing the vending machine kinetic energy and preventing the vending machine from rocking in the opposite direction.

While for these specific examples, a spring device is used as the actuating member for the cylinder means mounted within the energy absorbing means of the vending machine, alternative embodiments in the pneumatics or hydraulic device could also be incorporated.

Also, the specific example of the vending machine was used merely to illustrate the functionality of the energy absorbing device. Any high center of gravity apparatus requiring self-stabilization would use the energy absorbing device.

While particular embodiments of the invention have been shown and described, it will be obvious to those skilled in the art that changes and modifications may be made without departing from the invention in its broader aspects and therefore the aim in the appended claims is to cover all such changes and modifications as filed in the true spirit and scope of the invention.

What is claimed is:

1. Vending apparatus comprising:

(A) a vending machine operable to vend products, said vending machine having a top, a base, and front and rear fixed feet for supporting the vending machine in a resting position upon a floor, said vending machine having such weight, including products to be vended, as to require the application of a lateral force on the order of one hundred (100) pounds to the top thereof to move said vending machine off one of said front and rear feet;

(B) a cylinder affixed to said base; and (C) piston means including:

(1) a piston head reciprocally mounted within said cylinder;

(2) a piston shaft affixed to said piston head and extending from said cylinder toward said floor;

(3) foot means affixed to said shaft for engaging said floor, and (4) energy absorbing means within said cylinder and engaging said piston head for urging said foot means toward said floor;

said foot means moving toward said floor and beyond said front and rear fixed feet when said vending machine is rocked off one of said front and rear fixed feet and engaging said floor before said one of said front and rear fixed feet when said vending machine is returned toward said resting position, said energy absorbing means compressing upon engagement of said foot means with said floor thereby absorbing said vending machine kinetic energy and slowing the return of said vending machine to said resting position.

2. The vending apparatus as defined in claim 1 wherein said energy absorbing means is a first spring means disposed within said cylinder against said piston head.

3. The vending apparatus as defined in claim 2 wherein said energy absorbing means further includes a second spring means disposed externally of said cylinder between said foot and said base of said vending machine.

* * * * *

UNITED STATES PATENT AND TRADEMARK OFFICE

CERTIFICATE OF CORRECTION

PATENT NO. : 5,156,451

DATED : October 20, 1992

INVENTOR(S) : Richard A. Pollock

It is certified that error appears in the above-identified patent and that said Letters Patent is hereby corrected as shown below:

Column 1, line 41, delete "mounted cell batrtery" and substitute therefor --mounting a wet cell battery--;

Column 3, line 45, delete "on" and substitute --or--

Column 4, line 65, delete "would-incorporate" and substitute therefore --would incorporate--;

Column 5, line 2, delete "2 second" and substitute therefor --2 seconds.--

Signed and Sealed this

Fifth Day of October, 1993

*Attest:*

Bruce Lehman

BRUCE LEHMAN

*Attesting Officer*

*Commissioner of Patents and Trademarks*